United States Patent [19]

Honeycutt, III

[11] Patent Number: 4,979,557

[45] Date of Patent: Dec. 25, 1990

[54] PROCESS FOR DIRECT CASTING OF CRYSTALLINE METAL SHEET IN STRIP FORM

[75] Inventor: LeRoy Honeycutt, III, Salisbury, N.C.

[73] Assignee: Reynolds Metals Company, Richmond, Va.

[21] Appl. No.: 383,644

[22] Filed: Jul. 24, 1989

[51] Int. Cl.[5] ..... B22D 11/06

[52] U.S. Cl. ..... 164/463; 164/121; 164/479

[58] Field of Search ..... 164/463, 479, 121, 158

[56] References Cited

U.S. PATENT DOCUMENTS

| | | | |
|---|---|---|---|
| 3,345,738 | 10/1967 | Mizikar et al. . | |
| 4,250,950 | 2/1981 | Buxmann et al. | 164/430 |
| 4,588,015 | 5/1986 | Liebermann | 164/463 |
| 4,600,048 | 7/1986 | Sato et al. | 164/463 |
| 4,676,298 | 6/1987 | Liebermann | 164/463 |
| 4,708,194 | 11/1987 | Mohn | 164/463 |
| 4,789,022 | 12/1988 | Ohno | 164/463 |
| 4,831,745 | 5/1989 | Brooks et al. | 164/158 X |

FOREIGN PATENT DOCUMENTS

| | | | |
|---|---|---|---|
| 2950406 | 6/1981 | Fed. Rep. of Germany . | |
| 3725010 | 9/1988 | Fed. Rep. of Germany . | |
| 61-9948 | 1/1986 | Japan | 164/463 |
| 61-193747 | 8/1986 | Japan | 164/463 |

OTHER PUBLICATIONS

Huang, S. et al., *Effects of Wheel Surface Conditions on the Casting of Amorphous Metal Ribbons, in Metallurgical Transactions A,* vol. 12A, pp. 1107–1112, Jun. 1981.

*Primary Examiner*—Nicholas P. Godici
*Assistant Examiner*—J. Reed Batten, Jr.
*Attorney, Agent, or Firm*—Lowe, Price, LeBlanc, Becker & Shur

[57] ABSTRACT

A method of direct casting crystalline metal sheet in continuous strip form from a melt of metal having a melting point below about 900° C. on a continuously driven substantially smooth chill surface cooled to extract heat from the strip being cast avoids gas pockets between the strip and chill surface by applying heat from an external source to the chill surface prior to the chill reentering the melt whereby vaporizable condensates and deposits on the chill surface are eliminated prior to contact with the melt.

6 Claims, 1 Drawing Sheet

PROCESS FOR DIRECT CASTING OF CRYSTALLINE METAL SHEET IN STRIP FORM

BACKGROUND OF THE INVENTION

1. Field of the Invention

This invention relates to a novel method of and apparatus for directly casting wide crystalline metal sheet and more particularly to such a method and apparatus for casting crystalline metal sheet directly from a melt of metal having a melting point below about 900° C.

2. Description of the Prior Art

In continuous strip casting processes wherein a layer of molten metal is delivered onto a moving chilled metal surface for solidification, uniform heat transfer from the molten metal to the chill is essential for the production of a product of commercially acceptable quality. Uneven heat transfer results in gauge variations and surface defects which can make subsequent rolling or other processing difficult or impossible and in extreme cases can result in damage to the casting equipment and excessive scrap.

In direct casting of crystalline metal sheet or strip on a continuous basis by the so-called melt drag process wherein a continuous chill surface moves through and out of a melt of the metal, a thin film of metal is solidified almost instantaneously upon contact with the chill. This film is firmly adhered to the chill and grows in thickness with continued heat extraction as it moves through and out of the melt. Rapid extraction of heat by the chill results in thermal shrinking of the formed strip until the bond between the strip and chill is broken, at which point there is a marked reduction in heat transfer from the strip to the chill.

One difficulty which has been encountered in direct casting of thin wide sheet in continuous strip form from metals having a relatively low melting temperature such as aluminum and zinc is the tendency of the strip to release from the chill in an uneven manner when cast upon a smooth chill surface. It has generally been considered that this results from the evolution of gases from the melt between the chill and strip which gases expand and cause localized premature separation of the strip from the chill surface. As a result, it has been proposed to cast such metals on chill surfaces having a pattern of fine, closely spaced grooves or channels providing escape passages for such gases.

While grooved chill surfaces have been successfully used in the production of wide crystalline metal sheet in a melt drag process, the use of such a chill surface is not entirely satisfactory for various reasons. For example, providing the necessary uniform grooving pattern over a large surface substantially increases the initial cost of the chill. Further, to be effective, the grooves should be relatively fine and closely spaced to provide both the required gas escape routes and effective heat transfer. Cleaning and maintenance of such a grooved chill, both during use and between casting runs, can result in changing or destroying the groove pattern, making it necessary to either regroove or replace the chill surface.

It has been discovered that in casting metals having a high melting temperature such as steel and some amorphous metals, the problems of uneven release due to localized gas pockets is not encountered after the initial start-up so that casting can be accomplished on a smooth chill surface. German Patent DE No. 2950406 discloses, however, that dew drops and gases from the ambient air, which condense on and adhere to the chill surface before casting commences, can vaporize and cause thin spots or depressions in the cast surface of amorphous metal strip at the beginning of a casting run. This adhering moisture is quickly evaporated by liquid metal having such high melting temperatures, however, so that the problem is eliminated once the chill surface temperature is stabilized during casting. To solve this problem at the beginning of a casting run, this German patent provides a heater at a location ahead of the point of contact between the melt and the chill surface to preheat the chill before flow of the molten metal is commenced. After the casting operation is commenced the heater is deenergized.

U.S. Pat. No. 4,250,950 also teaches that, in the direct strip casting of aluminum, impurities including organic substances, hydroxides and various salts which contain water of crystalization may accumulate on a chill surface, generating gases upon contact with the molten aluminum and requiring the system of channels or grooves to permit escape routes for the gases.

The production of metal sheet in continuous strip form by a melt drag process on a commercial basis requires operation in an industrial environment which frequently contains vapors of various substances such as lubricating oils which may adhere to or condense on a clean smooth chill surface operating at temperatures normally encountered in such operations when casting metals such as aluminum or zinc, having relatively low melting temperatures. Even minute quantities of such substances can produce pockets of gas adversely affecting the heat transfer when suddenly heated to the melting point of the metal being cast.

SUMMARY OF THE INVENTION

It has been discovered that aluminum and other metals having a melting temperature below about 900° C. can be directly cast into thin wide crystalline sheet in continuous strip form in accordance with the present invention without requiring the use of grooves, channels, or other means providing gas escape passages between the chill and the strip being cast. This is accomplished by maintaining the chill surface which contacts the melt, preferably by reheating the surface immediately prior to reentering the melt, at a temperature which vaporizes any water or other material which has condensed on the surface and removing any water of crystalization from salt crystals which could become vaporized upon contact with the molten metal to be cast. In accordance with the preferred embodiment of the invention, a high intensity heat source is provided adjacent the chill surface at a location just prior to the surface contacting the molten metal whereby only the surface portion of the chill is heated to liberate any vapors while minimizing the adverse effect on the cooling capacity of the chill substrate surface. The temperature of the chill surface immediately prior to contact with the melt is at least about 185° C. and preferably at least about 200° C.

BRIEF DESCRIPTION OF THE DRAWINGS

The foregoing and other features and advantages of the invention will be apparent from the detailed description contained herein below, taken in conjunction with the drawings, in which.

DESCRIPTION OF THE PREFERRED EMBODIMENTS

Figure 1:
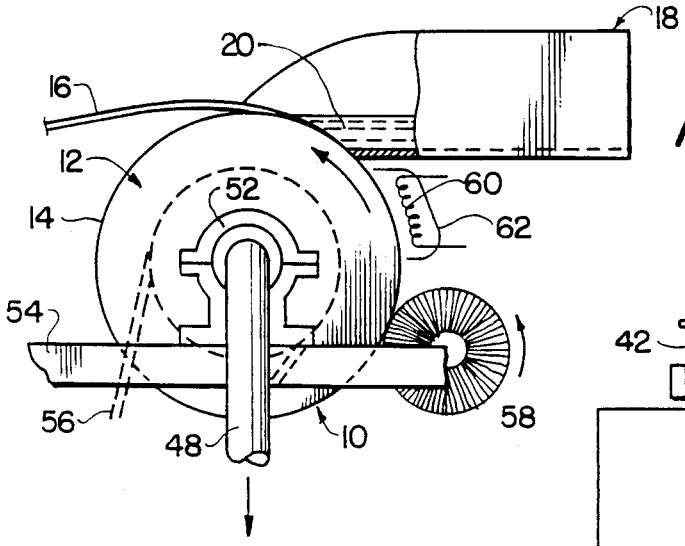
FIG. 1 is a fragmentary side elevation view of a direct strip casting apparatus according to the present invention, with portions broken away to more clearly show other parts.

Referring now to the drawings in detail, a melt drag strip casting apparatus suitable for use in the practice of the present invention is illustrated schematically in FIG. 1 and is designated generally by the reference numeral 10. The apparatus includes a chill 12 in the form of a casting wheel or drum having a cooled cylindrical outer surface 14 upon which the metallic strip 16 is cast. A tundish assembly 18 is supported in close proximity to the casting wheel 12 in a position to supply molten metal 20 contained therein at a uniform depth into contact with the chill surface 14.

Figure 2:
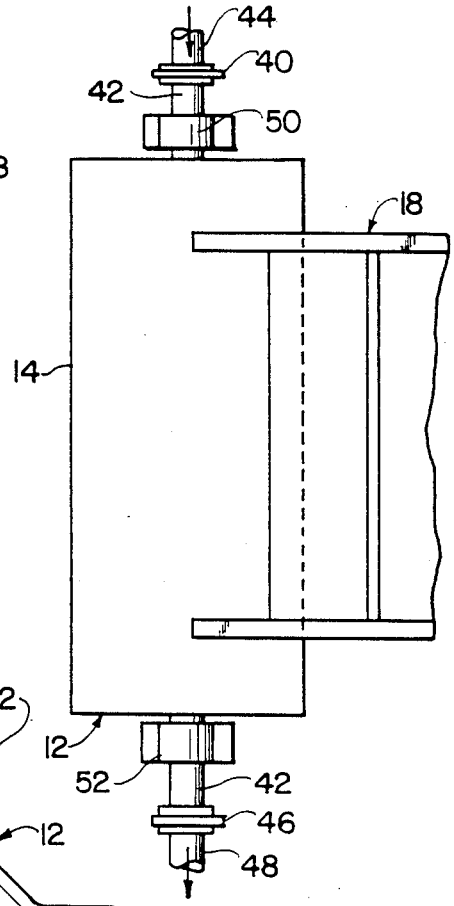
FIG. 2 is a top plan view of a portion of the structure shown in FIG. 1.
Figure 3:
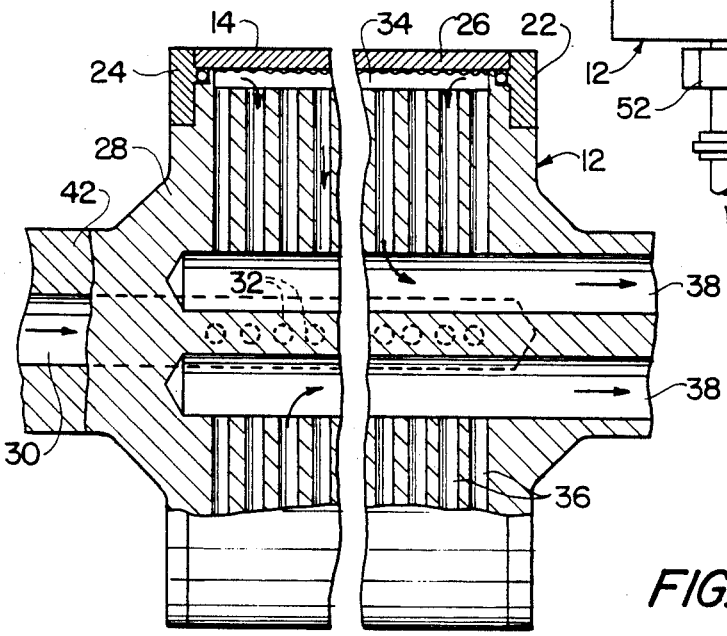
FIG. 3 is an enlarged fragmentary view, partially in section, of the chill wheel used in the apparatus of FIGS. 1 and 2.

The casting wheel 12 is internally cooled with circulating water or other cooling fluid to enable the rapid extraction of heat through surface 14 to thereby quench and solidify liquid metal from the melt 20 which contacts the peripheral casting surface 14 as it rotates upward through the melt in tundish 18. Internally cooled casting wheels are known as shown, for example, in U.S. Pat. No. 2,348,178, and as schematically illustrated in FIG. 3. Such a wheel may comprise a hollow drum made from a pair of end flanges 22, 24, and an outer peripheral rim 26, the cylindrical surface of which defines the chill or casting surface 14. A central hub 28 supported within the peripheral rim 26 has a pair of axially extending bores 30 communicating with radially extending passages 32 which, in turn, communicate with the annular space 34 between the hub 28 and the peripheral rim 26. Similarly, radially extending passages 36 provide fluid communication between the annular space 34 and a pair of axially extending outlet passages 38. Thus, cooling water entering through inlets 30 flows outwardly through the radial passages 32 then circumferentially around the annular space 34 before being discharged through radial passages 36 and axial passages 38. As shown in FIG. 2, a suitable rotary coupling 40 connects the central shaft 42 of chill wheel 12 to an inlet conduit 44 and a second coupling 46 connects shaft 42 to an outlet conduit 48 to enable continuous circulation of cooling fluid through the chill while the chill is driven for rotation about its horizontal axis. Suitable bearings 50, 52 journal shaft 42 for rotation on a rigid frame indicated at 54 in FIG. 1, and drive means such as a variable speed motor acting through the belt 56 indicated schematically in FIG. 1 is provided for driving the chill wheel about its horizontal axis. Preferably a rotary brush 58 is driven in contact with the chill surface 14 to remove debris and to maintain a uniform coating of natural oxide on the surface. Brush 58 may have bristles of silicon carbide impregnated synthetic resin or other suitable material to maintain the smooth, clean oxide coating without abrading the metal substrate of the chill surface 14.

In the preferred embodiment of the invention illustrated in FIG. 1, a high intensity heat source is located adjacent the smooth chill wheel surface 14 at a position between brush 58 and the bottom of tundish 18 to apply heat across the full width of the chill surface which will be contacted by the melt 20. In FIG. 1, the high intensity heat source is schematically shown as a radiant heating coil 60 with a reflector shield 62 directing the heat onto the rotating chill surface 14.

In operation of the apparatus just described, chill surface 14 will be rapidly heated by the melt 20 commencing at the bottom of the tundish upon initial contact with the molten metal and continuing until the chill surface is separated from the moving strip. Simultaneously, cooling water circulating through the interior of the chill wheel will continuously extract heat from the inner surface of the shell or rim 26 as it rotates about its axis to reenter the molten metal bath 20. Substantial heat will also be dissipated from surface 14 through air cooling and by radiation.

In an aluminum strip casting operation using a chill wheel having a 27.8 inch diameter driven at a surface speed of 200 feet per minute, from the time any point on chill surface 14 contacts the molten metal at the bottom of tundish 18 until the solidified strip is released from the surface as a result of thermal contraction of the strip requires only about 0.08 seconds. After release, the hot strip will remain in contact with the chill surface for a short time during which heat will flow from the strip to the chill at a reduced rate. Heat is extracted continuously from the chill surface by the circulating water throughout the full revolution of wheel 12, or approximately 2.2 seconds, so that under normal operating conditions the surface 14 may be cooled to the point that minute quantities of vapor from the atmosphere can be condensed on the surface prior to the surface reentering the melt 20.

It is apparent that numerous factors will influence the temperature of the surface 14 at the point of contact with the melt during an extended casting run. These factors will include the thickness and thermal conductivity of the shell 26, the temperature and volume of cooling liquid flowing through the chill wheel, ambient air temperature and, to a much smaller degree, the nature and color of oxide coating on the chill which can influence radiation from the surface. The speed of operation of the apparatus, the temperature of the melt 20 and radiation from the bottom of tundish 18 will also influence the temperature of surface 14.

The thickness of shell 26 is usually determined as a compromise between that required for rapid extraction of heat from the strip being formed and to cool surface 14 by the circulating cooling liquid, and that required for dimensional stability of shell 26. A thinner shell will result in a more rapid cooling of surface 14 after contact with the metal being cast while a thicker shell will provide greater dimensional stability. A thicker shell may be required when casting metals having a high melting temperature such as steel and this thicker shell will, in turn, result in a slower cooling of surface 14 by the circulating cooling liquid. Conversely, in casting metals having a relatively low melting temperature, for example, a melting temperature below about 900° C., shell 26 will be subjected to less severe thermal shock than in casting steels or other high temperature metals, thereby enabling the use of a substantially thinner shell and a more rapid cooling of the surface 14.

It has been found that in casting metals having melting temperatures below about 900° C. the surface 14 can be cooled to a temperature immediately before reentering the melt which will result in vaporizable materials accumulating or condensing on and adhering to the surface. The pockets of gas which can occur between the forming strip and the chill surface are now believed to be the result of these materials revaporizing upon contact with the molten metal rather than from the evolution of gas from the melt itself as previously believed. In any event, by applying intense heat to the surface for a short period of time just prior to the surface reentering the melt, vaporizable material adhering to the surface is eliminated without the body of shell 26 absorbing sufficient heat to materially affect the casting rate. Further, the application of such intense heat for a short time enables the use of a lower temperature cooling liquid which can compensate for the heat added to the surface of the chill.

It is apparent that when the temperature of surface 14 remains above 100° C. throughout the casting operation, water vapor from the atmosphere cannot condense onto the surface. However, other vaporizable materials such as oils or other airborne vapors can condense on the chill at higher temperatures and salts which have water of crystalization that is released at temperatures above 100° C. may be deposited on the chill and it is necessary for the temperature of surface 14 to be substantially above about 100° C. to eliminate gas between the strip and chill surface. To accomplish this, the surface 14 should be at a temperature of at least about 185° C. and preferably at least about 200° C. to eliminate water of crystalization and other vaporizable condensates. The use of the oxide polishing brush 58 will tend to minimize the collection of salt crystals on the casting surface, and where the apparatus is operated in reasonably clean ambient atmosphere, a surface temperature for the chill of 200° C. or slightly above when initially contacting the melt at the bottom of the tundish will eliminate essentially all gas pockets between the chill and the strip being formed, thereby resulting in a uniform strip release. This enables the high speed production of wide, thin crystalline metal sheet in continuous strip form from metals having a melting temperature below about 900° C. As used herein, the terms "sheet" and "strip" are intended to mean metal having a thickness in the range of about 0.015 to about 0.080 inches and a width of at least 12 inches.

It is conventional practice in melt drag strip casting of crystalline sheet metal to preheat the chill roll surface to eliminate vaporizable material from the casting surface before commencing the casting operation. In such known practices, however, the separate heat source is discontinued when the casting operation is commenced. In accordance with the present invention, it is important to continuously apply heat to the surface throughout the casting operation to eliminate the gas pockets which produce non-uniform release. It is also important to supply such heat over a short period of time and near the point of reentry of the chill surface into the melt so that sufficient heat will not be absorbed by the surface to materially reduce the cooling rate of the strip contacting the chill. The heat source 60 should thus be located no more than about 90° and preferably no more than about 45% from the point of reentry of the chill surface into the melt when a cylindrical chill is employed. Also, by locating the heat source 60 between the melt and the oxide removing brush, heat damage to the brush bristles as a result of contact with the reheated chill surface is avoided.

It has also been found advantageous to apply a release coating to the casting surface during preheating of a chill surface to facilitate start up of the casting process. Very fine graphite powder, or colloidal graphite, applied by an aerosol spray has been found effective for this purpose. Application of the graphite in an inert gas carrier does not interfere with the removal of vaporizable condensates from the chill surface during preheating.

While preferred embodiments of the invention have been disclosed and described in detail, it should be apparent that the invention is not so limited and it is intended that the invention include all embodiments which would be apparent to one skilled in the art and which come within the spirit and scope of the invention.

What is claimed is:

1. In the method of direct casting crystalline metal sheet in a continuous strip from a melt of metal having a melting point below about 900° C., including providing a melt of the metal to be cast, providing a continuously driven metal casting member which is continuously cooled to provide a chill surface for contacting and extracting heat from the metal sheet being cast, said chill surface being substantially smooth and free of discontinuities providing gas escape passages between a strip of metal being cast and the chill surface, flowing a layer of the melt onto the moving chill surface and extracting heat from the layer of melt through the chill surface to solidify and temporarily bond the layer of melt to the chill surface and to shrink the solidified layer and cause it to be released from the chill surface, said layer having a width of the least about 12 inches, and withdrawing the released solidified layer as a continuous metal strip having a thickness in the range of about 0.015 to 0.080 inches, the improvement comprising continuously applying heat from an external source immediately upstream of said melt to maintain said chill surface entering the melt at a temperature of at least about 185° C. throughout the casting operation whereby any volatile substance on the chill surface is vaporized prior to contact with the melt, the temperature of said chill surface entering the melt being such that a thin film of metal from the melt solidifies and adheres to the chill surface substantially instantaneously upon contact with the chill surface.

2. The invention defined in claim 1 wherein the temperature of said chill surface at the point of contact with the melt is maintained above about 200° C.

3. The invention defined in claim 2 further comprising the step of contacting said chill surface with a driven rotary brush for removing debris from the chill surface and to maintain a smooth continuous oxide coating on the chill surface throughout the casting operation.

4. The invention defined in claim 3 wherein said chill surface is the external cylindrical surface of an internally cooled rotary drum, and wherein heat is applied to said chill surface at a location between said rotary brush and the point of reentry of the chill surface into the melt.

5. The invention defined in claim 4 wherein said heat source comprises a radiant heater supported adjacent said chill surface at a location within about 90° from the point of reentry of the chill surface into contact with the melt.

6. The invention defined in claim 5 wherein said heat source is located within about 45° from the point of reentry of the chill surface into contact with the melt.

* * * * *